US010907456B2

(12) United States Patent
Batarseh et al.

(10) Patent No.: US 10,907,456 B2
(45) Date of Patent: Feb. 2, 2021

(54) METHODS FOR FRACTURING A FORMATION CONTAINING HYDROCARBONS USING AN ENABLER THAT HEATS IN RESPONSE TO ELECTROMAGNETIC RADIATION

(71) Applicant: Saudi Arabian Oil Company, Dhahran (SA)

(72) Inventors: Sameeh Issa Batarseh, Dhahran (SA); Haitham A. Othman, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/407,622

(22) Filed: May 9, 2019

(65) Prior Publication Data

US 2020/0088020 A1 Mar. 19, 2020

Related U.S. Application Data

(62) Division of application No. 16/130,140, filed on Sep. 13, 2018, now Pat. No. 10,794,164.

(51) Int. Cl.
*E21B 43/26* (2006.01)
*E21B 43/24* (2006.01)

(52) U.S. Cl.
CPC ..... *E21B 43/26* (2013.01); *E21B 43/24* (2013.01); *E21B 43/2401* (2013.01); *E21B 43/2405* (2013.01)

(58) Field of Classification Search
CPC ..... E21B 43/26; E21B 43/24; E21B 43/2401; E21B 43/2405
See application file for complete search history.

(56) References Cited

U.S. PATENT DOCUMENTS

| | | | | |
|---|---|---|---|---|
| 295,245 | A | 3/1884 | Gruson | |
| 1,422,204 | A | 7/1922 | Hoover | |
| 3,189,092 | A * | 6/1965 | Bodine | E21B 43/003 166/249 |
| 3,241,611 | A | 3/1966 | Dougan | |
| 3,284,281 | A | 11/1966 | Thomas | |

(Continued)

FOREIGN PATENT DOCUMENTS

| | | | |
|---|---|---|---|
| WO | WO-2017163265 | A1 | 9/2017 |
| WO | WO-2020/053636 | A1 | 3/2020 |

OTHER PUBLICATIONS

Aresco, Microwave Fracking: The New Hydraulic Fracturing?, 6 pages (Jun. 21, 2018). URL: http://www.arescotx.com/microwave-technology-the-new-fracking/ [Retrieved Jul. 3, 2018].

(Continued)

*Primary Examiner* — David J Bagnell
*Assistant Examiner* — Jonathan Malikasim
(74) *Attorney, Agent, or Firm* — Choate, Hall & Stewart LLP; Charles E. Lyon; Alexander D. Augst

(57) ABSTRACT

An example tool for fracturing a formation includes a body having an elongated shape and fracturing devices arranged along the body. Each fracturing device includes an antenna to transmit electromagnetic radiation and one or more pads that are movable to contact the formation. Each pad includes an enabler that heats in response to the electromagnetic radiation to cause fractures in the formation.

13 Claims, 10 Drawing Sheets

(56) References Cited

U.S. PATENT DOCUMENTS

| | | | | |
|---|---|---|---|---|
| 3,400,762 | A | 9/1968 | Peacock et al. | |
| 3,455,391 | A | 7/1969 | Matthews et al. | |
| 3,468,376 | A | 9/1969 | Slusser et al. | |
| 3,513,914 | A | 5/1970 | Vogel | |
| 4,140,180 | A | 2/1979 | Bridges et al. | |
| 4,757,873 | A | 7/1988 | Linyaev et al. | |
| 7,828,057 | B2 * | 11/2010 | Kearl | E21B 43/2401 166/248 |
| 8,162,052 | B2 | 4/2012 | Goodwin et al. | |
| 8,701,760 | B2 | 4/2014 | Parsche | |
| 8,807,220 | B2 | 8/2014 | Madison et al. | |
| 8,936,090 | B2 | 1/2015 | Sultenfuss et al. | |
| 9,353,612 | B2 | 5/2016 | Batarseh | |
| 9,719,328 | B2 | 8/2017 | Al-Buraik | |
| 9,970,246 | B2 | 5/2018 | Hoelscher et al. | |
| 9,970,276 | B2 | 5/2018 | Grounds, III et al. | |
| 10,253,608 | B2 | 4/2019 | Batarseh et al. | |
| 2008/0230219 | A1 | 9/2008 | Kaminsky | |
| 2012/0012319 | A1 | 1/2012 | Dennis | |
| 2012/0073798 | A1 | 3/2012 | Parsche et al. | |
| 2012/0118565 | A1 | 5/2012 | Trautman et al. | |
| 2012/0125609 | A1 | 5/2012 | Parsche | |
| 2012/0205109 | A1 | 8/2012 | Burnham et al. | |
| 2014/0360778 | A1 | 12/2014 | Batarseh | |
| 2015/0021008 | A1 | 1/2015 | Batarseh | |
| 2015/0021013 | A1 | 1/2015 | Batarseh | |
| 2015/0129222 | A1 | 5/2015 | Wright et al. | |
| 2016/0069857 | A1 | 3/2016 | Batarseh et al. | |
| 2016/0123123 | A1 * | 5/2016 | Maclean | F04B 17/04 166/372 |
| 2016/0160618 | A1 | 6/2016 | Batarseh et al. | |
| 2016/0326839 | A1 | 11/2016 | Ayub et al. | |
| 2017/0074447 | A1 | 3/2017 | Batarseh et al. | |
| 2017/0130570 | A1 | 5/2017 | Al-Nakhli et al. | |
| 2018/0163524 | A1 | 6/2018 | Batarseh | |
| 2020/0088019 | A1 | 3/2020 | Batarseh et al. | |

OTHER PUBLICATIONS

International Search Report for PCT/IB2018/057821, 5 pages (dated May 22, 2019).

Written Opinion for PCT/IB2018/057821, 8 pages (dated May 22, 2019).

* cited by examiner

METHODS FOR FRACTURING A FORMATION CONTAINING HYDROCARBONS USING AN ENABLER THAT HEATS IN RESPONSE TO ELECTROMAGNETIC RADIATION

CROSS REFERENCE TO RELATED APPLICATION

This application is a divisional of U.S. patent application Ser. No. 16/130,140, filed Sep. 13, 2018. This application claims the benefit of priority to U.S. patent application Ser. No. 16/130,140. The disclosure of U.S. patent application Ser. No. 16/130,140 is incorporated herein by reference in its entirety.

TECHNICAL FIELD

This specification relates generally to example downhole tools for fracturing a formation containing hydrocarbons.

BACKGROUND

Fracturing—also known as "fracking"—includes creating fractures or cracks in a rock formation containing hydrocarbons in order to permit the hydrocarbons to flow from the formation into a wellbore. In some fracturing processes, fluid is injected into the formation at a pressure that is greater than a fracture pressure of the formation. The force of the fluid creates fractures in the formation and expands existing fractures in the formation. Hydrocarbons in the formation then flow into the wellbore though these formed fractures.

SUMMARY

An example tool for fracturing a rock formation containing hydrocarbons includes a body having an elongated shape and fracturing devices arranged along the body. Each fracturing device includes an antenna to transmit electromagnetic radiation and one or more pads that are movable to contact the formation. Each pad includes an enabler that heats in response to the electromagnetic radiation to cause fractures in the formation. The example tool may include one or more of the following features either alone or in combination.

The electromagnetic radiation may be microwave radiation or radio frequency radiation. The enabler may include activated carbon. The enabler may include one or more of steel, iron, or aluminum. The enabler may have a composition that supports heating up to 800° Fahrenheit or 426.7° Celsius The fracturing devices may each be rotatable around the body and relative to a wall of a wellbore through the formation. The body may include multiple segments. Each of the segments may include one of the fracturing devices. The body may be configured for addition or removal of one or more segments. The body may be flexible at multiple locations. There may be two pads in each fracturing device.

A source of electromagnetic radiation may provide the electromagnetic radiation to the antenna. The source may be located inside the wellbore. The source may be located on a surface.

The tool may include acoustic sensors to detect a speed at which sound travels through the formation. One or more processing devices may be configured—for example programmed—to determine a property of the formation based on the speed detected. The property may be a compressive stress of the formation.

An example method of fracturing a formation includes positioning pads of a downhole tool against a wall of a wellbore through the formation. The pads may include an enabler that heats in response to the electromagnetic radiation. The example method includes transmitting the electromagnetic radiation to the pads thereby heating the enabler to cause fractures in the formation. Fluid may be injected into the fractures to expand the fractures and to create additional fractures in the formation. The example method may include one or more of the following features either alone or in combination.

The method may include receiving the electromagnetic radiation from a source and transmitting the electromagnetic radiation to the pads via an antenna. The method may include obtaining data relating to a speed of sound through the formation and processing the data to determine properties of the formation based on the speed detected. The properties may include at least one of strength, deformation, or resistance of rock in the formation.

The method may include removing the downhole tool from the wellbore before injecting the fluid. The method may also include pumping to the surface hydrocarbons output from the formation through the fractures and the additional fractures.

The electromagnetic radiation may be microwave radiation. The electromagnetic radiation may be radio frequency radiation. The enabler may include activated carbon. The enabler may include one or more of steel, iron, or aluminum. The enabler may have a composition that supports heating up to 800° Fahrenheit or 426.7° Celsius.

The pads may be part of at least one fracturing device on the downhole tool. Positioning the pads may include moving arms of the at least one fracturing device that hold the pads. Positioning the pads may include rotating the at least one fracturing device.

The method may include moving the downhole tool to a different location within the wellbore and repositioning the pads against the wall of the wellbore. The electromagnetic radiation may be transmitted to the pads thereby heating the enabler to cause fractures in the hydrocarbon-bearing rock formation at the different location. Fluid may be injected into the fractures at the different location to expand the fractures at the different location and to create additional fractures at the different location.

The method may include assembling the downhole tool by connecting multiple segments in series. Each of the multiple segments may include a body and a fracturing device arranged on the body. The fracturing device includes an antenna to transmit the electromagnetic radiation and at least one of the pads.

An example tool for fracturing a rock formation containing hydrocarbons includes a body having an elongated shape and fracturing devices arranged along the body. Each fracturing device includes one or more pads that are movable to contact the formation. Each pad is controllable to apply heat to the formation to cause fractures in the formation. The example tool may include one or more of the following features either alone or in combination.

The one or more pads may be heated using induction heating, using resistive heating, or using electromagnetic radiation. Each pad is connectable to an arm that is extendible away from the body and retractable towards the body.

Any two or more of the features described in this specification, including in this summary section, may be combined to form implementations not specifically described in this specification.

At least part of the tools and processes described in this specification may be controlled by executing, on one or more processing devices, instructions that are stored on one or more non-transitory machine-readable storage media. Examples of non-transitory machine-readable storage media include read-only memory (ROM), an optical disk drive, memory disk drive, and random access memory (RAM). At least part of the tools and processes described in this specification may be controlled using a data processing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DESCRIPTION OF THE DRAWINGS

Like reference numerals in different figures indicate like elements.

DETAILED DESCRIPTION

Figure 1:
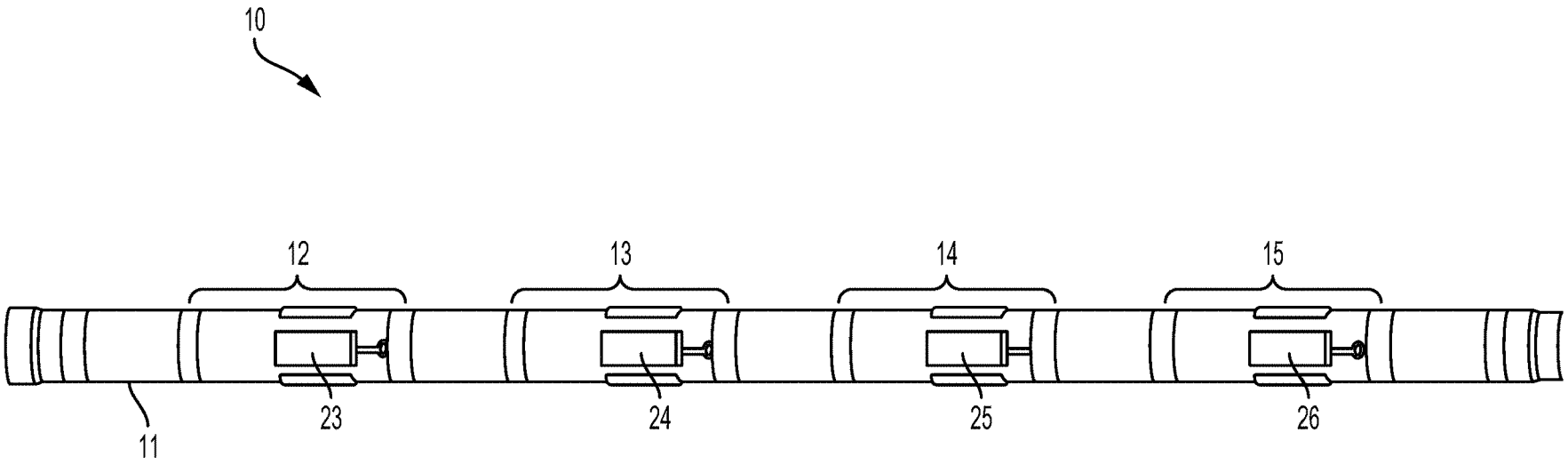
FIG. 1 is a side view of an example downhole tool for fracturing a formation.

Described in this specification are example downhole tools for fracturing a rock formation containing hydrocarbons (referred to as a "formation") and example methods for fracturing the formation using those tools. An example tool includes a body assembled from multiple segments. The tool is modular in the sense that segments may be added to the tool or removed from the tool to change its length. Each segment includes a fracturing device. The fracturing device includes articulated arms connected to pads. The arms are controllable to extend outwardly from a non-extended position to an extended position to cause the pads to make frictional contact with a wall surface of a wellbore. The pads are heated when they are in contact with the formation. Heat from the pads transfers to the formation, which causes fractures to form or pre-existing fractures to expand in the formation. In some implementations, each pad includes an enabler such as activated carbon that heats in response to electromagnetic radiation such as microwave radiation or radio frequency (RF) radiation. An antenna may be included in the fracturing device to transmit the electromagnetic radiation to the pads to cause the enabler to heat. In some implementations, the pads may be heated electrically.

In some cases, the tool may be moved within the wellbore to target different parts of the formation. For example, the tool may be moved uphole or downhole to create fractures in different parts of the formation. The fracturing devices are also rotatable to target different locations along the circumference of the wellbore.

After the fractures are formed using the tool, the tool may be removed from the wellbore. Fracturing may then be performed using hydraulic fluid. The hydraulic fluid may include water mixed with chemical additives and proppants such as sand. The hydraulic fluid is injected into the wellbore to expand the fractures produced using the downhole tool and to create additional fractures in the formation. The additional fractures permit hydrocarbons to flow into the wellbore. The hydrocarbons may then be removed from the wellbore through pumping.

Fracturing using hydraulic fluid may be of the multistage type. In an example multistage fracturing process, hydraulic fluid is injected into the wellbore in a region near the end of the wellbore. The fluid expands the fractures created in the formation using the downhole tool and creates additional fractures in that region. A cement plug is then positioned in the wellbore to isolate that region from the rest of the wellbore. Hydraulic fluid is injected into the wellbore in a next region uphole from the isolated region to expand the fractures created in that region using the downhole tool and to create additional fractures in that region. A cement plug is then positioned in the wellbore to isolate that next region from the rest of the wellbore. This process may be repeated multiple times to produce multiple fractured regions in the formation. A drill then cuts through the cement plugs to allow hydrocarbons to flow through the fractures to reach the wellbore.

FIG. 1 shows an example implementation of a downhole tool 10 (referred to as "tool 10") for fracturing a formation. Tool 10 includes a body 11 having multiple segments. In this example, the tool includes four segments 12, 13, 14, and 15. However, the tool may include any number of segments such as one segment, two segments, three segments, five segments, six segments, or twelve segments. As noted, the tool is modular. Segments may be added to the tool to increase the length of the tool in order to target additional regions of the formation contemporaneously. Segments may be removed from the tool to decrease the length of the tool in order to target fewer regions of the formation. In some implementations, the number of segments that make up the tool may be based on the length of a wellbore through the formation. The tool may be assembled uphole by connecting multiple segments together using connection mechanisms. For example, segments may be screwed together or connected using clamps, bolts, screws, or other mechanical connectors. Other tools, instruments, or segments may be located in a string between or among the segments to customize the spacing between or among the segments.

Figure 2:
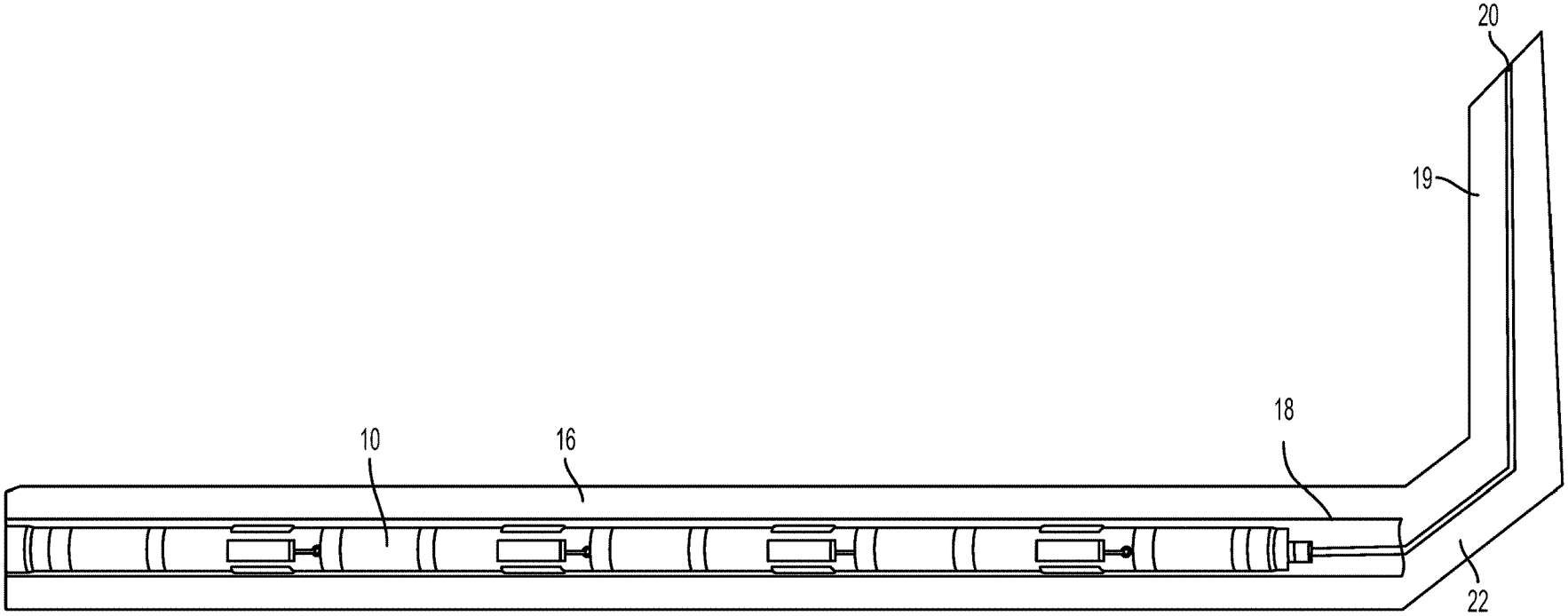
FIG. 2 is a side view of the downhole tool within a wellbore.

The tool is flexible to allow it bend around deviated portions of the wellbore during insertion and removal. For example, FIG. 2 shows tool 10 contained within the horizontal part 16 of wellbore 18. In order to reach the horizontal part, the tool is lowered into a vertical part 19 of wellbore 18 using a coiled tubing unit 20 or a wireline. The tool bends while passing through deviated portion 22 between vertical part 19 and horizontal part 16. In some implementations, the tool may be flexible at the connection between two segments. In some implementations, the tool may be flexible at the interior of individual segments. Flexibility may be achieved by incorporating materials, such as flexible metal or flexible composite, at locations along the length of the tool where flexion is desired.

In some implementations, each segment includes a fracturing device. For example, tool 10 includes four fracturing devices 23, 24, 25, and 26—one for each segment. Each of the fracturing devices may have the same structure and function. Accordingly, only one fracturing device is described.

Figure 3:
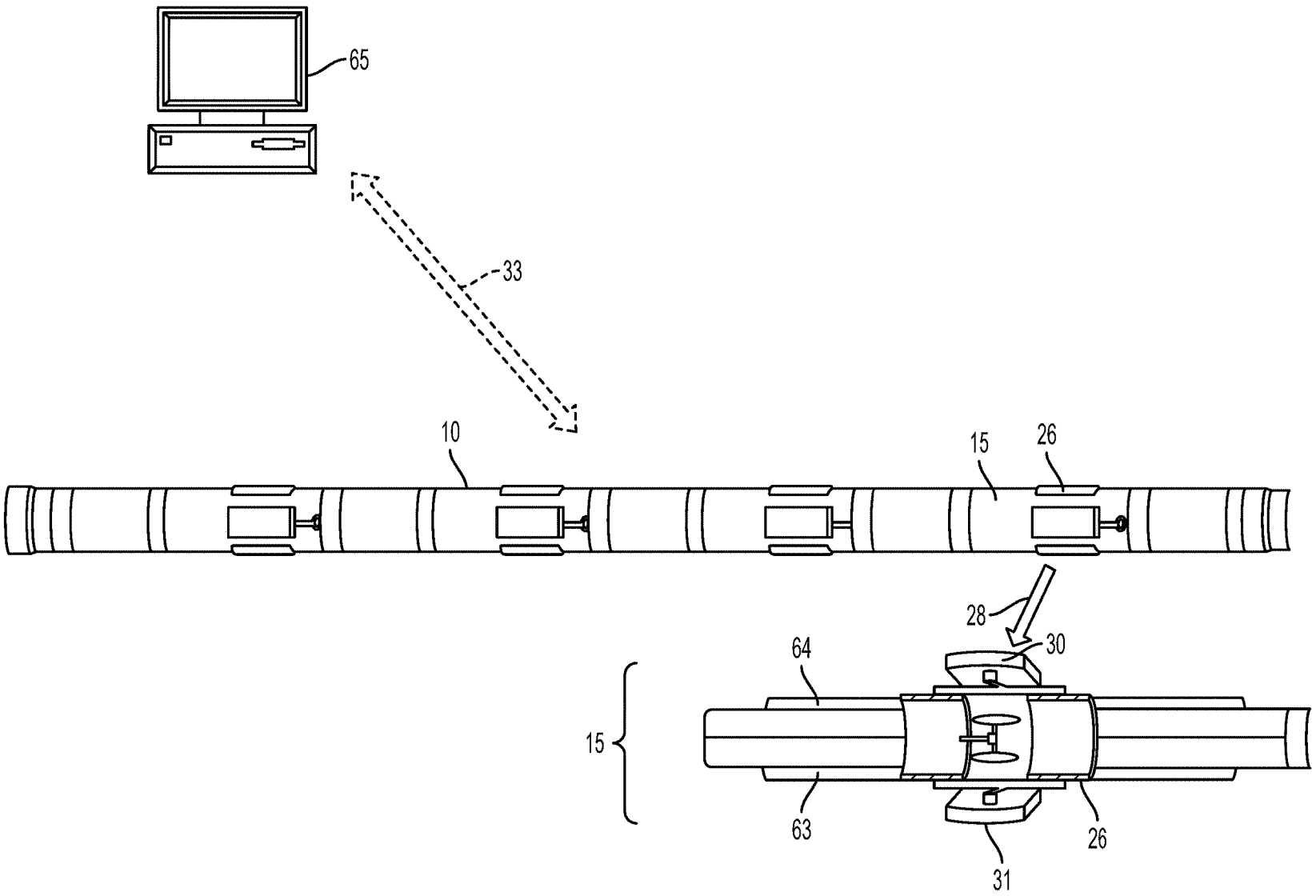
FIG. 3 is a side view of the downhole tool together with a close-up, cross-sectional view of a segment of the downhole tool.
Figure 4:
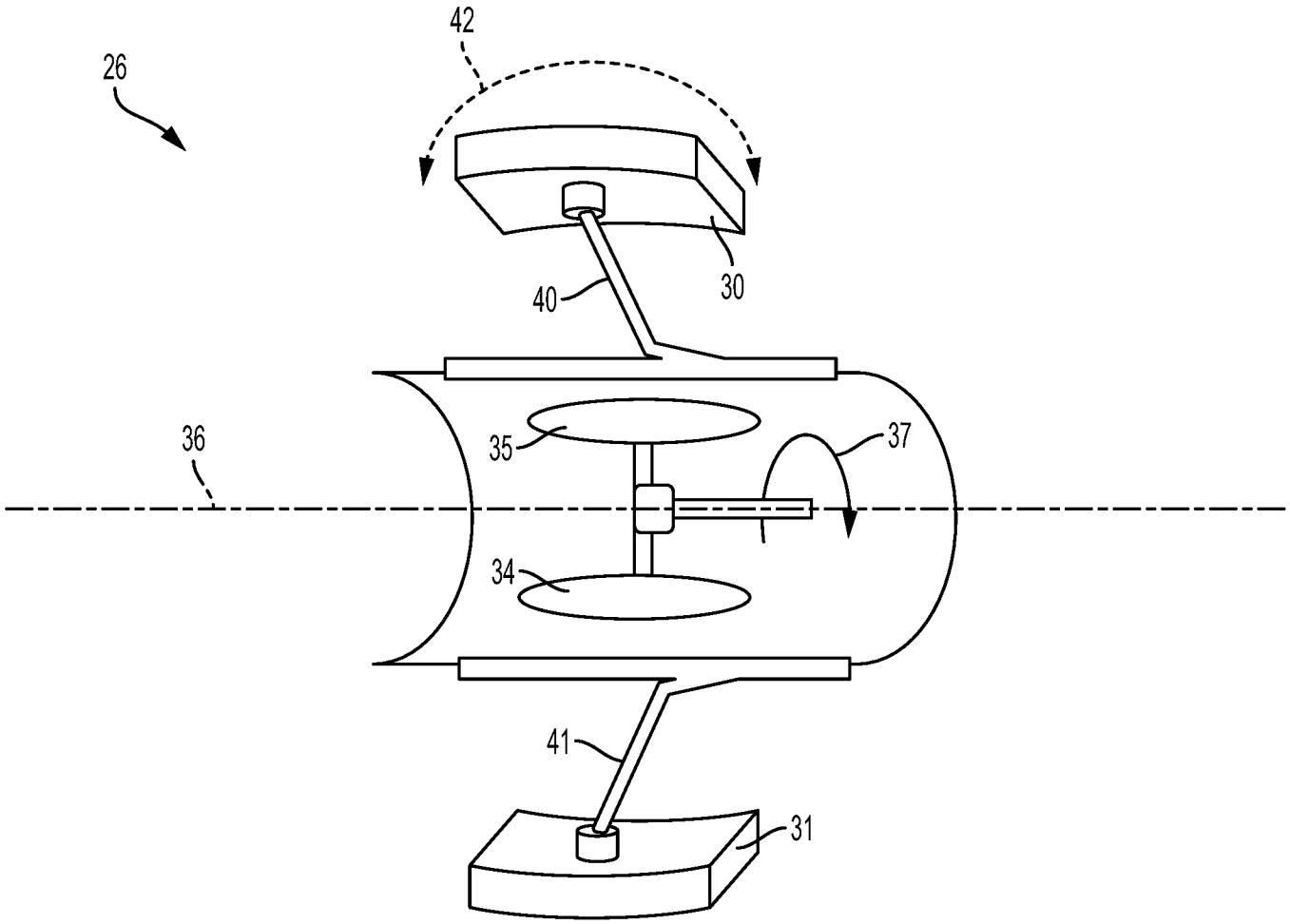
FIG. 4 is a cross-sectional view of an example fracturing device included within the downhole tool.

FIG. 3 includes a cut-away, close-up view of part of example segment 15. Magnification of segment 15 is represented conceptually by arrow 28. Segment 15 includes example fracturing device 26. FIG. 4 shows a cut-away, close-up view of fracturing device 26. Fracturing device 26 includes pads 30 and 31 that are configured to move away from the tool body towards the wellbore wall surface. If FIG. 3, the pads are partly extended and in FIG. 4 the pads are fully extended.

Two pads are included in fracturing device 26; however, the fracturing device may include fewer than two pads or more than two pads. For example, the fracturing device may include a single pad or three pads, four pads, five pads, or six pads. In some implementations, each pad contains an enabler. An enabler includes material that increases in temperature in response to electromagnetic signals such as microwave radiation or RF radiation. Examples of electromagnetic signals that may be used to heat the enabler include electromagnetic signals within a range of 915 megahertz (MHz) to 2.45 gigahertz (GHz).

An example of an enabler that heats in response to microwave or RF radiation is activated carbon. Example activated carbon has pores in the range of 2 nanometers (nm) to 50 nm in diameter. When exposed to microwave or RF radiation, activated carbon heats-up to about 800 degrees (°) Fahrenheit (F) (426.7° Celsius (C)). The activated carbon in the pads may be in the form of a powder or granules. In some implementations, the activated carbon may be combined with one or more powders or granules of steel, iron, or aluminum to strengthen the enabler. The powdery or granular structure of the pads makes the pads pliable. For example, the enabler and the material that forms the pads partially or wholly conform to the surface of the formation including uneven surfaces. As a result, there is direct surface contact to convey heat from the pad to the formation.

In some implementations, fracturing device 26 also includes antennas 34 and 35. Two antennas are shown; however, the fracturing device may include fewer than two antennas or more than two antennas. The antennas transmit electromagnetic radiation to the pads. In some implementations, the antennas are rotatable around the longitudinal dimension 36 of the tool to direct the electromagnetic radiation evenly to multiple pads. Rotation is depicted conceptually by arrow 37. In some implementations, rotation may be up to and including 360°. In some implementations, rotation may exceed 360°.

As noted, examples of electromagnetic radiation that may be used to heat the fracturing devices include microwave radiation and RF radiation. One or more sources for the electromagnetic radiation may be located on the surface or downhole. For example, a source of electromagnetic radiation may be located in each segment or in each fracturing device. The source transmits the electromagnetic radiation to the antennas. Each antenna receives electromagnetic radiation from one or more sources and transmits that electromagnetic radiation to the pads. In response to the electromagnetic radiation, the pad increases in temperature as explained previously.

Referring to FIG. 4, fracturing device 26 includes arms 40 and 41 that are connected to pads 30 and 31 respectively. When activated, the fracturing device moves the pads outwardly towards the wellbore wall surface. The pads are moved by extending the arms outwardly. For example, the arms may start at a position where the pads are fully retracted against the fracturing device. The arms may extend outward following activation. As noted, FIG. 3 shows a case where the arms are partly extended. FIG. 4 shows a case where the arms are fully extended.

Extension of the arms and thus of the pads connected to the arms forces the pads against the rock formation to be fractured. For example, the arms force the pads against the wellbore wall surface. As noted, the pads have sufficient pliability to conform to an uneven surface of the wellbore wall surface to maximize their surface contact. The pads may be pivotally mounted on their respective arms to enable at least partial rotation along arrow 42. The rotation of the pads along arrow 42 also promotes maximal contact to uneven surfaces of the wellbore.

Figure 5:
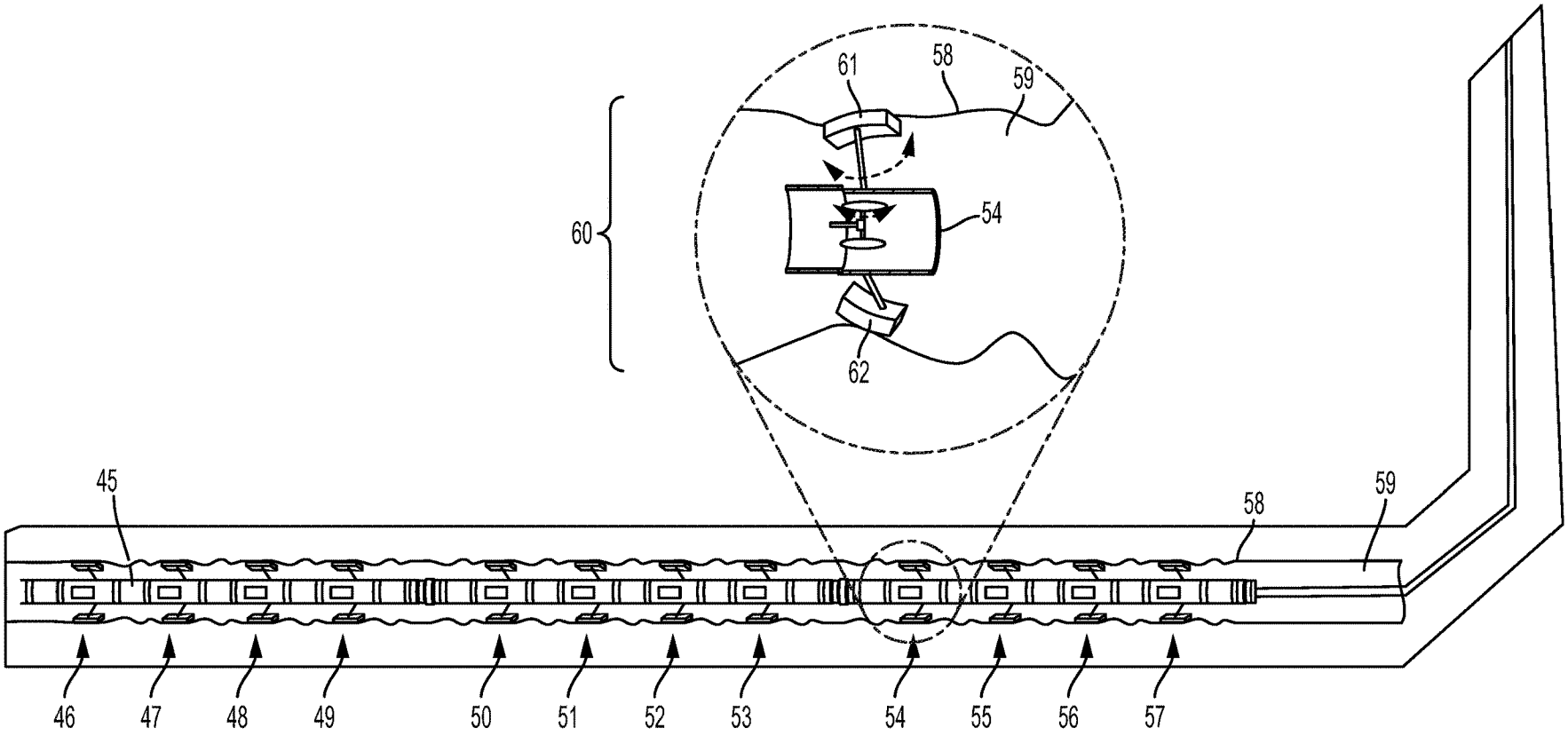
FIG. 5 is a side view of another example downhole tool within a wellbore together with a close-up, cross-sectional view of an activated fracturing device.

FIG. 5 shows an example tool 45 that is of the same type as tool 10 but that is comprised of twelve segments and corresponding fracturing devices 46, 47, 48, 49, 50, 51, 52, 53, 54, 55, 56, and 57. In this example, the pads of fracturing devices 46 to 57 are each in contact with the wall 58 of wellbore 59. Magnified view 60 shows how pads 61 and 62 of fracturing device 54 generally conform to the uneven surface of wellbore 59 at the location of fracturing device 54 along the wellbore.

In some implementations, each fracturing device is rotatable along a longitudinal dimension of the tool. This rotation is depicted conceptually by arrows 37 in FIG. 4 (the same arrow that depicts rotation of the antennas). In some implementations, rotation may be up to and including 360°. In some implementations, rotation may exceed 360°. The rotation may be implemented using a motor. The fracturing device may be rotated to align the pads to locations on a circumference of the wellbore where fracturing is to be initiated using the tool. In some implementation, repositioning the pads through rotation requires that the pads be retracted from the wellbore wall surface.

Referring to FIG. 3, each segment may also include one or more sensors. In this example, the sensors includes acoustic sensors 63 and 64. The acoustic sensors may be fiber optic acoustic sensors. Fiber optic acoustic sensors detect the speed of sound through the formation. For example, an acoustic source (not shown) may be located on each segment. The fiber optic acoustic sensors may detect sound transmitted from the acoustic source and that same sound traveling through and reflected from within the formation. Data representing this sound information may sent to a computing system 65 located at a surface or downhole.

The computing system may be configured—for example, programmed—to determine the speed of sound through the formation based on the sound transmitted and on the sound reflected from the formation. The speed of sound through the formation may be used to determine the following properties of rock contained in the formation: Young's Modulus, Poisson's ratio, shear, bulk density, and compressibility. These properties correspond to the strength, deformation, and resistance of the rock. Based on these properties, a region of the formation can be identified for fracturing. For example, if the rock in the formation is strong and under compressive stress in a region, then that region is characterized as a good candidate for fracturing since fractures will propagate easier and faster in formations under stress than in formations not under stress. In an example, a region that is under stress for the purposes of this application includes rock that fractures at a pressure that is greater than 400 kilopascal (kPa).

Operation of the tool to create fractures in a formation may be controlled using a computing system. For example, a drilling engineer may input commands to the computing system to control operation of the tool based on regions identified for fracturing. Examples of computing systems that may be used are also described in this specification.

In an example, communication cables such as Ethernet or other wiring may carry commands and data between the computing system and the tool. The commands may be generated using computing system 65 and may control operation of the tool. For example, the commands may include commands to activate one or more fracturing devices selectively, to rotate one or more fracturing devices, to move the tool, or to transmit electromagnetic signals to heat the fracturing devices. The segments may include local electronics capable of receiving and executing the commands. Acoustic data may be transmitted to the computing system via fiber optic media. In some implementations, wireless protocols may be used to send commands downhole to the tool and to send data from the tool to the computing system. For example, RF signals may be used for wireless transmission of commands and data. Dashed arrow 33 in FIG. 3 represents the exchange of commands and data between the downhole tool and the computing system.

The computing system may include circuitry or an on-board computing system to enable user control over the positioning and operation of the downhole tool. The on-board circuitry or on-board computing system are "on-board" in the sense that they are located on the tool itself or downhole with the tool, rather than at the surface. The circuitry or on-board computing system may communicate with the computing system on the surface to enable control over operation and movement of the tool. Alternatively, the circuitry or on-board computing system may be used instead of the computing system located at the surface. For example, the circuitry or on-board computing system may be configured—for example programmed—while on the surface to implement control instructions in a sequence while downhole.

Figure 6:
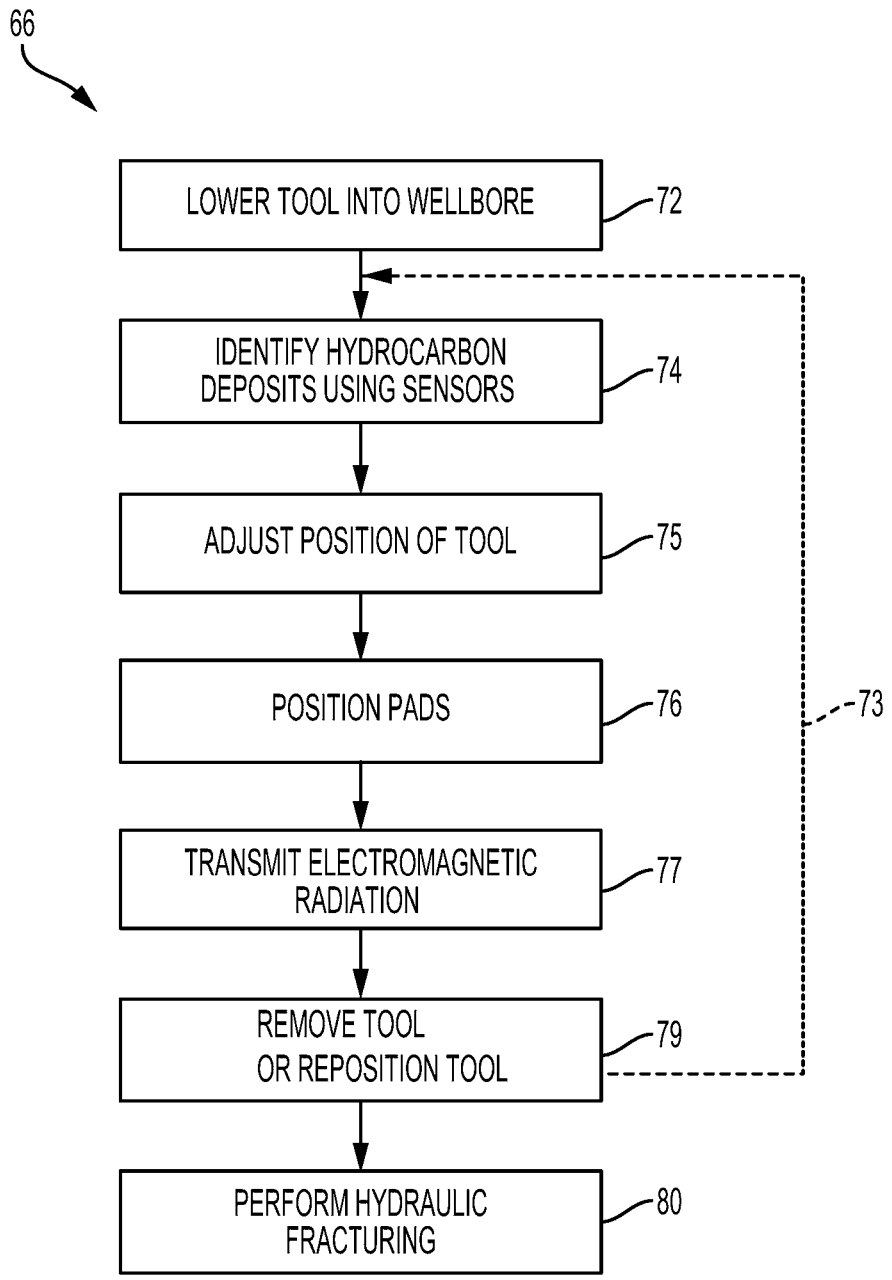
FIG. 6 is a flowchart containing example operations for performing fracturing using the downhole tool.

FIG. 6 shows an example fracturing process 66 that uses a downhole tool such as tool 10 or tool 45. Initially, the tool is lowered (72) into position in the wellbore where fracturing is to be performed. For example, the tool may be lowered into the wellbore using a coiled tubing unit or a wireline. For example, the tool may be moved through the wellbore to reach the end of the wellbore or to reach another part of the wellbore that is to be fractured using the tool. These locations may be determined beforehand based on knowledge about the length of the wellbore, geological surveys of the formation, and prior drilling in the area, for example.

Sensors may be employed to identify (74) locations of deposits of hydrocarbons within the formation. In an example, acoustic sources may generate sound waves. Those sound waves travel through the formation and are reflected from within the formation. The acoustic sensors detect the levels of the generated sound waves and of reflected sound waves that traveled through the formation. Data representing the levels of these sound waves is sent in real-time to computing system 65. In this regard, real-time may not mean that two actions are simultaneous, but rather may include actions that occur on a continuous basis or track each other in time, taking into account delays associated with data processing, data transmission, and hardware. As explained previously, the computing system uses the data to determine properties of the formation such as its strength, deformation, or resistance. These properties may be used to identify regions of the formation that are to be targeted for fracturing using the tool. In this regard, in some cases deposits of hydrocarbons may be located in segregated pockets of the formation and may not be evenly distributed throughout the formation. The acoustic data may be used to identify the locations of these deposits.

If necessary, the position of the tool may be adjusted (75) based on the locations to be targeted for fracturing as determined by the acoustic sensors. For example, the tool may be moved uphole or downhole so that its pads are in a relative position in the wellbore to contact the parts of the formation that are nearest to the deposits of hydrocarbons within the formation. Thus, the position of the tool may be adjusted to improve or to maximize the impact of fracturing performed in regions nearest to the deposits of hydrocarbons.

Process 66 includes positioning pads (76) of the tool against the wellbore wall surface. As noted, commands from the computing system may control positioning of the pads. Positioning may include rotating the fracturing device or the pads so that the pads align at least partly to the region of the formation to be fractured. For example, the pads may be aligned so that heat is directed to the region to be fractured. The region may be identified through acoustic analysis of the formation as described previously. Other information may also be used to identify the locations of the regions, such as geological surveys of the formation and knowledge obtained through prior drilling of the formation. Positioning also includes activating the fracturing device by extending the arms outward so that the pads come into contact with the formation. Because the pads are pliable, the pads conform to the surface of the wellbore upon contact. As a result, contact between the pads and the surface of the wellbore can be maximized in some cases.

Electromagnetic radiation such as microwave radiation is transmitted (77) to the pads. As explained previously, the electromagnetic radiation is transmitted to the pads via antennas 34 and 35 (FIG. 4) for example. In some implementations, the antennas rotate during transmission of the electromagnetic radiation in order to ensure that each pad receives an equal amount of radiation. In some implementations, the antennas are static during transmission of the electromagnetic radiation. The electromagnetic radiation heats the enabler to about 800° F. (426.7° C.) in some examples. In some implementations, the enabler may be heated to less than 800° F. (426.7° C.) or to greater than 800° F. (426.7° C.). The amount of heat that is generated is based on factors such as the type of enabler used, the duration of exposure of the enabler to the electromagnetic radiation, and the intensity of the electromagnetic radiation to which the enabler is exposed.

The heat from the pads is transferred to the formation. This heat causes fractures to form in the formation or existing fractures in the formation to spread or to expand. The duration for which heat is applied may be based on properties of the formation such as the strength, deformation, or resistance of rock in the formation. For example, the greater the strength or resistance of the rock, the longer the duration that heat may need to be applied. The fractures produced by the tool may be referred to as microfractures, since the fractures produced by the tool are often smaller or shorter than fractures produced during hydraulic fracturing. The fractures produced by the tool, however, need not be smaller or shorter than fractures produced during hydraulic fracturing.

Figure 7:
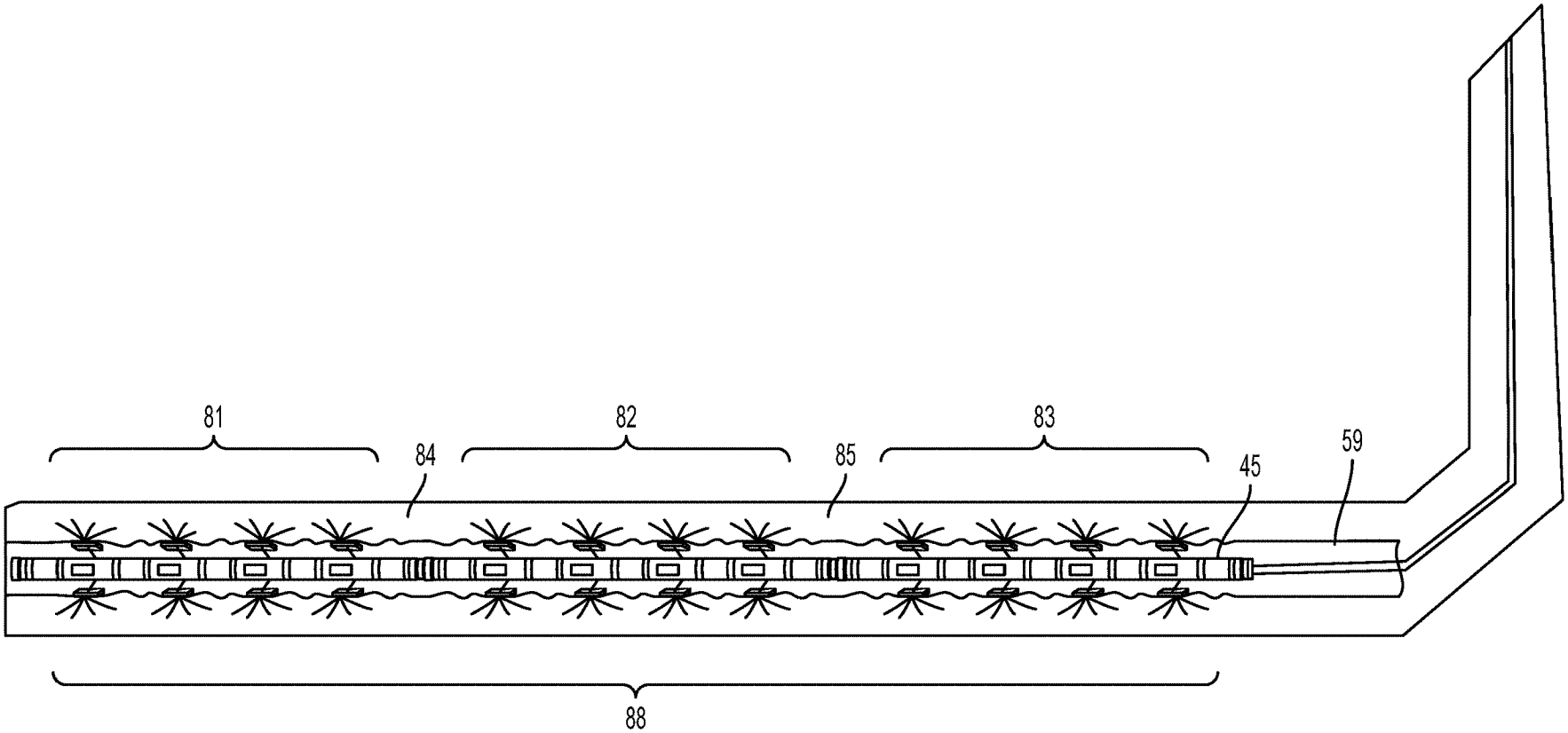
FIG. 7 is a cross-sectional view of the downhole tool of FIG. 5 showing fractures formed in a formation by the downhole tool.

FIG. 7 shows tool 45 of FIG. 5 within wellbore 59 producing fractures 88 by applying heat via the pads of the tool. In this example, the fractures are primarily in three regions 81, 82, and 83. In some implementations, the fractured regions may correspond to locations of deposits of hydrocarbons contained within the formation. Each fractured region is separated from an adjacent fractured region by an intervening region 84 or 85 of the formation that includes no fractures or fewer fractures than can be found in the fractured regions. In some cases, these intervening regions may correspond to locations of the formation that contain little or no hydrocarbons.

Referring back to FIG. 6, following creation of fractures in the rock, the tool may be removed (79) from the wellbore in some cases. To remove the tool, the arms retract which causes the pads also to retract. That is, the pads move out of contact with the wellbore wall surface and towards the tool. In some implementations, the pads are retracted so that they are flush with the tool body.

In some implementations, the tool may be repositioned within the wellbore in order to create fractures at a different location. Repositioning and the operations that follow repositioning are indicated in FIG. 6 by dashed line 73. In an example, if the wellbore is 50 m long and the tool is 25 m long, the tool may fracture the final 25 m of the wellbore. Then, the tool may be moved uphole and into position to fracture the initial 25 m of the wellbore. This repositioning may include moving the tool to a different location within the wellbore, repositioning the pads against the wall of the wellbore, and transmitting the electromagnetic radiation to the pads to heat the enabler. In any case, after all target regions within the wellbore have been treated using the tool, the tool may be removed from the wellbore. The tool may be removed from the wellbore using a coiled tubing unit or a wireline.

Figure 8:
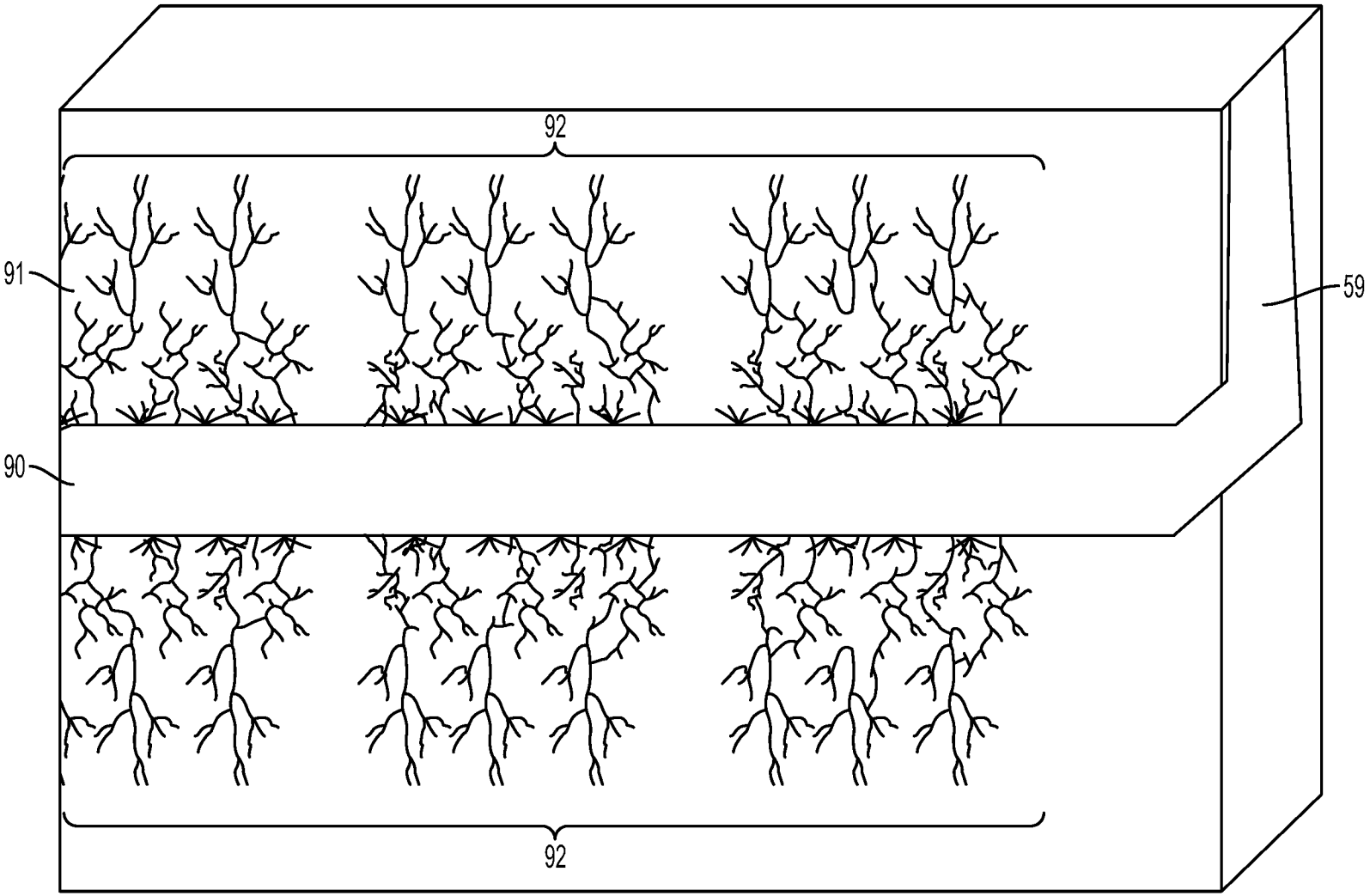
FIG. 8 is a cross-sectional view of a formation subjected to hydraulic fracturing.

Following removal of the tool, hydraulic fracturing is performed (80) to expand the microfractures in the formation created by the tool and to create additional fractures in the formation. Referring to FIG. 8, hydraulic fracturing includes injecting fluid 90 into the formation 91 through a conduit introduced into wellbore 59. The conduit may be a pipe that includes perforations along its longitudinal dimension. Explosives may be fired within the pipe through the perforations in order to create fractures 92 in the formation and to expand existing fractures in the formation, including the microfractures. Hydraulic fluid, which may include a mixture of water, proppants, and chemical additives is forcefully pumped through the perforations and into the fractures. In some implementations, the fluid is pumped at a force of 0.75 pounds-per-square-inch per foot (psi/ft) (16,965.44 kilograms per meters-squared seconds-squared ($kg/m^2s^2$). The fluid causes the fractures to crack, to expand, and to branch-out in order to reach hydrocarbons in the formation. Hydrocarbons in the formation then flow into the wellbore though these formed fractures. The hydrocarbons may then be pumped from the wellbore to the surface.

Figure 9:
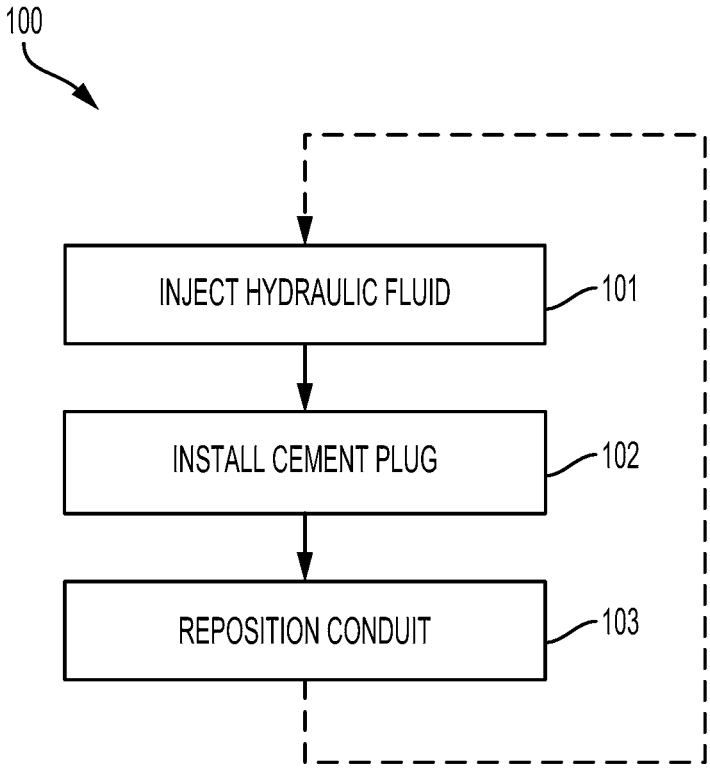
FIG. 9 is a flowchart containing example operations for performing a multistage fracturing process using the downhole tool.
Figure 10:
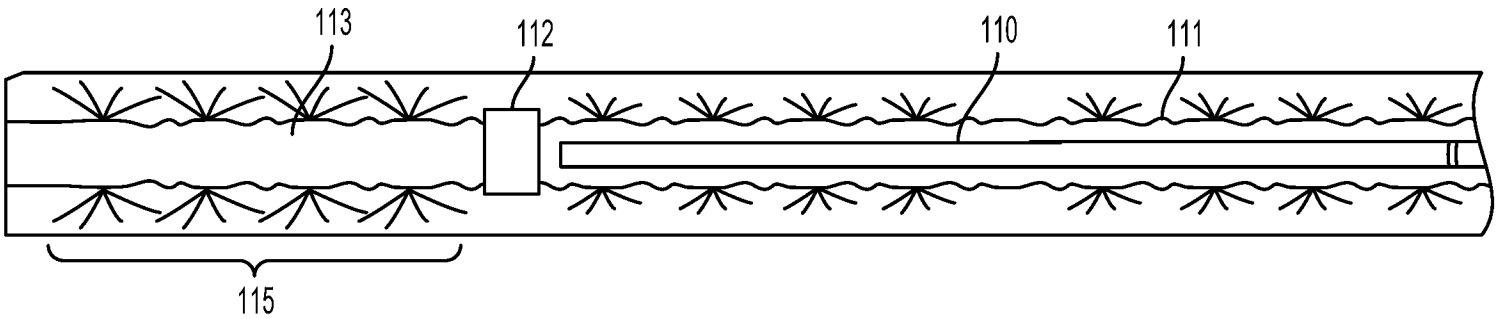
FIG. 10 is a cross-sectional view of a fluid injection conduit used during the multistage fracturing process.

In some implementations, the fracturing performed using hydraulic fluid may be multistage. Referring to FIG. 9, in an example multistage fracturing process 100 hydraulic fluid is injected (101) into the wellbore in a target region. For example, the hydraulic fluid may be injected at or near the end of the wellbore. The fluid expands the fractures created in the formation using the downhole tool and creates additional fractures in that region. A cement plug is then installed (102) in the wellbore to isolate that fractured region from the rest of the wellbore. For example, FIG. 10 shows a fluid injection conduit 110 in a wellbore 111. In the example of FIG. 10, hydraulic fluid has been injected into region 113 through conduit 110 to expand cracks 115. Cement plug 112 is then installed to isolate region 113 from the remainder of wellbore 111. Conduit 110 is then repositioned (103) in the wellbore in a next region uphole from the isolated region 113. Process 100 is then repeated in that next region. That is, hydraulic fluid is injected into the wellbore in a next region uphole from the isolated region 113 to expand the fractures created in that region using the downhole tool and to create additional fractures in that region. A cement plug is then positioned in the wellbore to isolate that next region from the rest of the wellbore. This process may be repeated multiple times to produce multiple fractured regions in the formation. A drill then cuts through the plugs, allowing hydrocarbons flowing from the fractures into the wellbore to reach the surface.

In some implementations, the tool may create microfractures near the end of the wellbore. The tool may then be removed from the wellbore. Hydraulic fluid may be injected in the region where the microfractures were created by the tool. The fluid expands the microfractures and creates additional fractures in that region. A cement plug is then positioned in the wellbore to isolate that region from the rest of the wellbore. The tool may then be lowered again into the wellbore to create microfractures a next region uphole from the isolated region. The tool may then be removed. Hydraulic fluid may be injected into the wellbore in the next region uphole from the isolated region to expand the microfractures and to create additional fractures in that region. A cement plug is then installed in the wellbore to isolate that next region from the rest of the wellbore. This process may be repeated multiple times to produce multiple fractured regions in the formation. A drill cuts through the plugs, allowing hydrocarbons from the fractures into the wellbore to reach the surface.

In some implementations, the example tool may include pads that are heated electrically rather than using an enabler and electromagnetic signals. In example, wires may run through the pads. The wires may be connected to an electrical power supply at the surface or downhole. Resistance in the wires causes the wires to heat when current passes through the wires. This heat may be applied to the formation through contact with the pads. In another example, the pads may be heated using an inductive heater. For example, each pad may include a metal coil that is connected to an electrical power supply. The power supply may output alternating current (AC) through the coil. A metal structure may be placed within our adjacent to the coil. Current through the coil creates eddy currents within the metal structure causing the metal structure to heat. This heat may be transferred to the formation.

The example tool may be used to create fractures in both conventional formations and unconventional formations, for example. An example conventional formation includes rock having a permeability of 1 millidarcy (md) or more. An example unconventional formation includes rock having a permeability of less than 0.1 md.

All or part of the tools and processes described in this specification and their various modifications may be controlled at least in part using a control system comprised of one or more computing systems using one or more computer programs. Examples of computing systems include, either alone or in combination, one or more desktop computers, laptop computers, servers, server farms, and mobile computing devices such as smartphones, features phones, and tablet computers.

The computer programs may be tangibly embodied in one or more information carriers, such as in one or more non-transitory machine-readable storage media. A computer program can be written in any form of programming language, including compiled or interpreted languages, and it can be deployed as a stand-alone program or as a module, part, subroutine, or unit suitable for use in a computing environment. A computer program can be deployed to be executed on one computer system or on multiple computer systems at one site or distributed across multiple sites and interconnected by a network.

Actions associated with implementing the processes may be performed by one or more programmable processors executing one or more computer programs. All or part of the tools and processes may include special purpose logic circuitry, for example, an field programmable gate array (FPGA) or an ASIC application-specific integrated circuit (ASIC), or both.

Processors suitable for the execution of a computer program include, for example, both general and special purpose microprocessors, and include any one or more processors of any kind of digital computer. Generally, a processor will receive instructions and data from a read-only storage area or a random access storage area, or both. Components of a computer (including a server) include one or more processors for executing instructions and one or more storage area devices for storing instructions and data. Generally, a computer will also include one or more machine-readable storage media, or will be operatively coupled to receive data from, or transfer data to, or both, one or more machine-readable storage media.

Non-transitory machine-readable storage media include mass storage devices for storing data, for example, magnetic, magneto-optical disks, or optical disks. Non-transitory machine-readable storage media suitable for embodying computer program instructions and data include all forms of non-volatile storage area. Non-transitory machine-readable storage media include, for example, semiconductor storage area devices, for example, erasable programmable read-only memory (EPROM), electrically erasable programmable read-only memory (EEPROM), and flash storage area devices. Non-transitory machine-readable storage media include, for example, magnetic disks such as internal hard disks or removable disks, magneto-optical disks, and CD (compact disc) ROM (read only memory) and DVD (digital versatile disk) ROM.

Each computing device may include a hard drive for storing data and computer programs, one or more processing devices (for example, a microprocessor), and memory (for example, RAM) for executing computer programs.

Elements of different implementations described may be combined to form other implementations not specifically set forth previously. Elements may be left out of the tools and processes described without adversely affecting their operation or operation of the overall system in general. Furthermore, various separate elements may be combined into one or more individual elements to perform the functions described in this specification.

Other implementations not specifically described in this specification are also within the scope of the following claims.

What is claimed is:

1. A method of fracturing a formation, the method comprising:

positioning pads of a downhole tool against a wall of a wellbore through the formation, the pads comprising an enabler that heats in response to electromagnetic radiation, where the pads are part of at least one fracturing device on the downhole tool; and where positioning the pads comprises moving arms of the at least one fracturing device that hold the pads or comprises rotating the at least one fracturing device;

transmitting the electromagnetic radiation to the pads thereby heating the enabler to cause fractures in the formation; and injecting fluid into the fractures to expand the fractures and to create additional fractures in the formation.

2. The method of claim 1, further comprising:

receiving the electromagnetic radiation from a source; and transmitting the electromagnetic radiation to the pads via an antenna.

3. The method of claim 1, further comprising:

obtaining data relating to a speed of sound through the formation; and processing the data to determine properties of the formation based on the speed detected.

4. The method of claim 3, where the properties comprise at least one of strength, deformation, or resistance of rock in the formation.

5. The method of claim 1, further comprising:

before injecting the fluid, removing the downhole tool from the wellbore.

6. The method of claim 1, further comprising:

pumping, through the wellbore, hydrocarbons from the formation through the fractures and the additional fractures.

7. The method of claim 1, where the electromagnetic radiation comprises microwave radiation.

8. The method of claim 1, where the electromagnetic radiation comprises radio frequency radiation.

9. The method of claim 1, where the enabler comprises activated carbon.

10. The method of claim 9, where the enabler further comprises one or more of steel, iron, or aluminum.

11. The method of claim 1, where the enabler has a composition that supports heating up to 800° Fahrenheit or 426.7° Celsius.

12. The method of claim 1, further comprising:

moving the downhole tool to a different location within the wellbore;

repositioning the pads against the wall of the wellbore;

transmitting the electromagnetic radiation to the pads thereby heating the enabler to cause fractures in the formation at the different location; and injecting fluid into the fractures at the different location to expand the fractures at the different location and to create additional fractures at the different location.

13. The method of claim 1, further comprising:

before positioning, assembling the downhole tool by connecting multiple segments in series, each of the multiple segments comprising:

a body; and at least one of the fracturing devices arranged on the body, the at least one of the fracturing devices comprising:

an antenna to transmit the electromagnetic radiation; and at least one of the pads.

* * * * *